United States Patent [19]

Nishikawa

[11] Patent Number: 4,457,993

[45] Date of Patent: Jul. 3, 1984

[54] ELECTROPHOTOGRAPHIC PROCESS OF RETENTION TYPE

[75] Inventor: Masaji Nishikawa, Hachioji, Japan

[73] Assignee: Olympus Optical Company Limited, Tokyo, Japan

[21] Appl. No.: 423,740

[22] Filed: Sep. 27, 1982

[30] Foreign Application Priority Data

Oct. 9, 1981 [JP] Japan ..... 56-160308

[51] Int. Cl.[3] ..... G03G 13/24

[52] U.S. Cl. ..... 430/54; 430/55; 430/126; 355/3 CH

[58] Field of Search ..... 430/55, 126; 355/3 CH

[56] References Cited

U.S. PATENT DOCUMENTS 4,230,783 10/1980 Aoki et al. ..... 430/55 X

FOREIGN PATENT DOCUMENTS 43-27582 11/1968 Japan ..... 430/55

*Primary Examiner*—John D. Welsh

*Attorney, Agent, or Firm*—Fleit, Jacobson, Cohn & Price

[57] ABSTRACT

An electrophotographic process for forming a given number of copies of an original once formed on a photosensitive member including a conductive drum, a photoconductive layer applied on the drum and an insulating layer applied on the photoconductive layer. The photosensitive member is first subjected simultaneously to a uniform exposure and a primary charging in one polarity, and then is subjected simultaneously to an imagewise exposure and a secondary A.C. charging. Next, the photosensitive member is subjected to a secondary uniform exposure with a reduced light intensity to such an extent that the charge image has an electrostatic contrast which is about 60 to 90 percent of the maximum attainable value. During the formation of copies by repeated development and transfer, the photosensitive member is subjected to an additional uniform exposure to restore the deterorated charge image.

10 Claims, 28 Drawing Figures

FIG. 1(III)
PRIOR ART
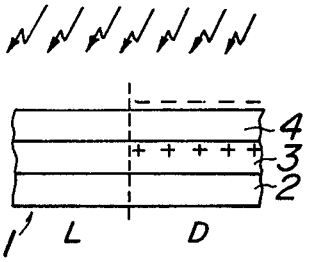
FIG. 3(III)
PRIOR ART
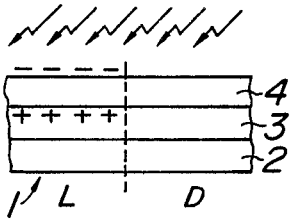

FIG_5(III)
PRIOR ART
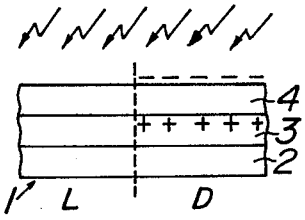
FIG_7(III)
PRIOR ART
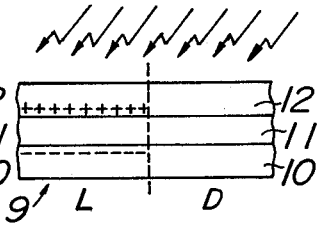

FIG_9(III)
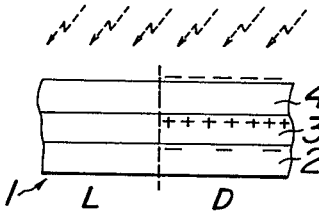

FIG. 11(III)
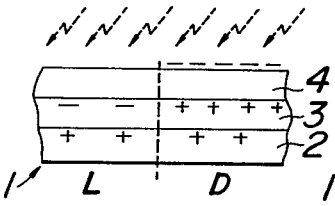

ELECTROPHOTOGRAPHIC PROCESS OF RETENTION TYPE

BACKGROUND OF THE INVENTION

The present invention relates to an electrophotographic process for forming a plurality of duplicated copies of an original by repeated development and transfer of the same and single electrostatic latent image of the original once formed on an electrophotographic photosensitive member.

Such an electrophotographic process is sometimes called a retention-type electrophotographic process and has been practiced in various kinds of duplicating machines. In this process, in order to obtain a plurality of copies having a high image quality, it is essential retain a latent image once formed on the photosensitive member for a long time period during which a plurality of copies are formed. Various methods have been proposed for retaining the latent image and avoiding deterioration thereof. However, in almost all known retention-type duplicating processes, the latent image deteriorates due to a leakage of electrostatic charge forming the latent image via a developing agent, an injection of electrostatic charge into the latent image via record papers and incompleteness of characteristics of the charge retaining member. Therefore, the electrostatic latent image is greatly impaired as the duplication process progresses and the image quality of the copies progressively decreases. There have been proposed various improvements for limiting the deterioration of the charge image as much as possible. But, heretofore it has been impossible to decrease the deterioration sufficiently.

Furthermore, in Japanese Patent Application Laid-open Publication No. 55,956/71, there is disclosed a method for restoring the deteriorated latent image during the duplication of a plurality of copies. In this known method, use is made of a photosensitive member in which a plurality of photoconductive layers having different spectral sensitivities and having different natural discharge properties (dark decay) are superimposed in a given order, and electrostatic latent images having opposite polarities are formed in dark across these photoconductive layers. When the latent image of one polarity is decays, the latent image of the other polarity decays correspondingly, whereby the whole latent image potential is maintained at an apparently constant level. In this manner, the latent image can be retained for a long time by cancelling potential leakage due to the development.

However, since such a method for retaining the latent image utilizes a photosensitive member having a special construction including photoconductive layers of different spectral sensitivities and one of the photoconductive layers must have a rectifying property, it can be applied only to a special electrophotographic process. That is to say, said known method has a drawback that the steps of duplication and printing are limited to special ones. Further, the variation of the potential of the latent image formed on the photosensitive member is determined by the dark decay of the photoconductors and therefore, there is another drawback that the image density might be changed during the formation of a number of copies.

SUMMARY OF THE INVENTION

The present invention has for an object to provide a novel and useful process for forming a plurality of duplicated copies from a single latent image once formed on a photosensitive member, in which the latent image can be maintained stably for a very long time period.

It is another object of the invention to provide a retention-type electrophotographic process in which the electrostatic contrast of the latent image can be restored during the formation of a plurality of copies.

It is still another object of the invention to provide a retention-type electrophotographic process which can form a number of copies from a single latent image without a variation in image density.

According to the invention, an electrophotographic process is provided for forming a plurality of copies of an original by repeated development and transfer for the same and single electrostatic charge image once formed on a photosensitive member which comprises a conductive substrate, a photoconductive layer and an insulating layer, these layers being applied on the conductive substrate. The process comprises (a) the step of effecting simultaneously an imagewise exposure of the original and charging for photosensitive member;

(b) the step of effecting a uniform exposure for the photosensitive member to such an extent that the electrostatic contrast of the charge image does not attain its maximum value; and (c) the step of restoring the charge image during the development and transfer.

DESCRIPTION OF THE PREFERRED EMBODIMENTS

Figure 1I:
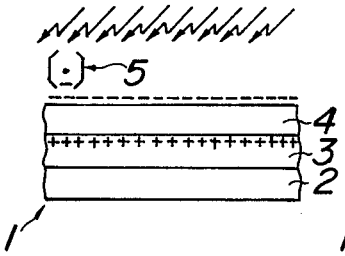
FIG. 1(I) PRIOR ART
FIGS. 1(I) to 1(III) are schematic views showing successive steps of an embodiment of a known electrophotographic process.
Figure 1:
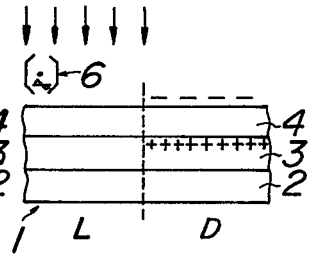
FIG. 1(II) PRIOR ART
Figure 2:
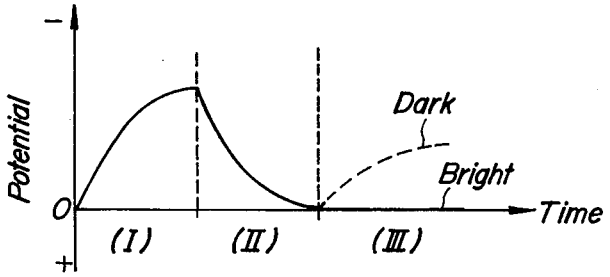
FIG. 2 PRIOR ART
FIG. 2 is a graph illustrating the variation of surface potentials in imagewise dark and bright areas in the steps shown in FIGS. 1(I) to 1(III)

FIGS. 1(I) to 1(III) are schematic views showing successive steps of an embodiment of a known typical electrophotographic process and FIG. 2 illustrates curves of surface potentials at imagewise dark and bright areas.

A photosensitive member 1 comprises a conductive substrate 2, a photoconductive layer 3 applied on the substrate 2 and an insulating layer 4 applied on the photoconductive layer 3. FIG. 1(I) shows a primary charging step in which the photosensitive member 1 is uniformly charged by a corona charger 5, while the member 1 is totally exposed to light. Then negative and positive charges are trapped in outer and inner surfaces of the insulating layer 4, respectively. During this uniform charging step, the surface potential of the photosensitive member 1 gradually increases in negative polarity as shown in range (I) in FIG. 2. It should be noted that it is not always necessary to effect uniform irradiation simultaneously with uniform charging, but uniform irradiation may be carried out after uniform charging. FIG. 1(II) illustrates a step for effecting simultaneously an imagewise exposure and a secondary charging. In order to remove the charge in an imagewise bright area, use may be made of an A.C. corona charger or a D.C. corona charger having a polarity opposite to that of the D.C. corona charger 5 for use in the primary charging. In an imagewise bright area L, since the photoconductive layer 3 becomes conductive, the charges are removed, but in an imagewise dark area D, since the positive charge trapped in an interface between the photoconductor 3 and the insulating layer 4 could not be moved, the negative charge on the insulating layer 4 is decreased to such an extent that the apparent potential becomes zero. Then, the photosensitive member 1 is subjected to a uniform exposure as shown in FIG. 1(III). During this step, a part of the positive charge trapped in the interface between the photoconductive layer 3 and the insulating layer 4 is discharged and an amount of the positive charge equal to that of the negative charge on the insulating layer 4 remains in the interface. In this manner, the external field is produced only in the imagewise dark area D as depicted in FIG. 1(III).

As shown in FIG. 2, during the primary charging step (I), the surface potential of the photosensitive member 1 is increased to a certain negative potential, and during step (II) the surface potential is uniformly decreased to zero. During the secondary uniform exposure step (III), the surface potential in the imagewise bright area L remains zero as shown by a thick solid line, while the surface potential in the imagewise dark area D is increased in accordance with the time of effecting the uniform exposure, as illustrated by a broken line, and becomes stable at a certain level. In this manner, electrostatic contrast is produced.

Figure 3I:
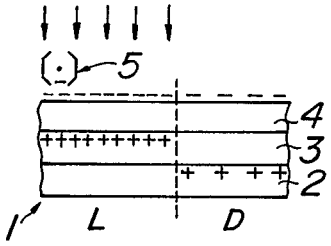
FIG. 3(I) PRIOR ART
FIGS. 3(I) to 3(III) are schematic views showing another embodiment of a known electrophotographic process.
Figure 3:
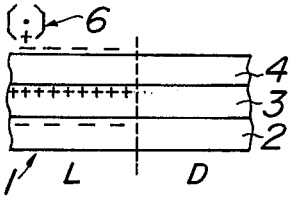
FIG. 3(II) PRIOR ART

FIGS. 3(I) to 3(III) show successive steps of another example of a known typical electrophotographic process. In that process, use is made of the same electrophotographic photosensitive member as that of the previous embodiment. FIG. 3(I) shows the step of effecting simultaneously an imagewise exposure and a primary charging by means of a corona charger 5. In an imagewise bright area L, since the photoconductive layer 3 becomes conductive, charges are trapped across the insulating layer 4, but in the imagewise dark area D, the charges are trapped between the outer surface of insulating layer 4 and an interface between the conductive substrate 2 and photoconductive layer 3. FIG. 3(II) illustrates the step of effecting a secondary charging. During this secondary charging step (II), the photosensitive member 1 is uniformly charged by a D.C. corona charger 6 of a polarity opposite to that of the D.C. corona charger 5 for effecting the primary charging. This may be carried out by an A.C corona charger instead of the D.C. corona charger 6. Then, the charges in the dark area D are completely removed, but in the bright area L, since the trapped charges could not be moved, the charge on the insulating layer 4 appears to be reduced and the external field becomes substantially zero.

Next, the photosensitive member 1 is totally irradiated as shown in FIG. 3(III). Then, a part of the charges trapped in the interface between the photoconductive layer 3 and insulating layer 4 is released and disappears, and there is produced a latent image by the charges trapped across the insulating layer 4.

Figure 4:
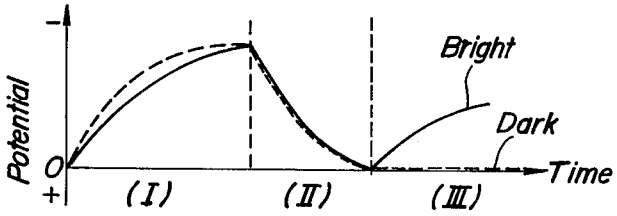
FIG. 4 PRIOR ART
FIG. 4 is a graph illustrating the change of surface potentials in the process shown in FIGS. 3(I) to 3(III)

FIG. 4 shows the variation of the surface potential during the above steps of FIGS. 3(I) to 3(III). The potentials in the imagewise bright and dark areas L and D are shown by thick solid and broken lines, respectively. During step (I), the surface potential is increased to a certain value in a negative sense and during step (II), the surface potentials are decreased to zero. In step (III), the potential in the dark area D does not change at all, but the potential in the imagewise bright portion L increases with time and then remains at a certain level. In this manner, the electrostatic latent image having the contrast is formed.

Figure 5I:
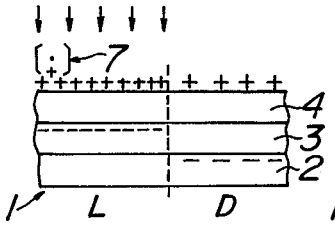
FIG 5(I) PRIOR ART
FIGS. 5(I) to 5(III) are schematic views depicting another embodiment of a known electrophotographic process.
Figure 5:
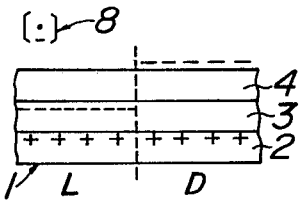
FIG 5(II) PRIOR ART

FIGS. 5(I) to 5(III) show successive steps of still another embodiment of a known electrophotographic process. Also, in this embodiment, use is made of the same photosensitive member 1 as that of the previous embodiments. FIG. 5(I) illustrates the step of effecting simultaneously an imagewise exposure and a primary charging with the aid of a corona charger 7 of positive polarity. In the bright area L, the charges are trapped across the insulating layer 4, but in the dark area D, the charges are trapped between the outer surface of the insulating layer 4 and the interface between the conductive substrate 2 and photoconductive layer 3. FIG. 5(II) illustrates the secondary charging step with an opposite polarity. During this step the photosensitive member 1 is uniformly charged in the dark area by a D.C. corona charger 8 of an opposite polarity to that of the corona charger 7. Then, in the bright area L, the charges on the outer surface of the insulating layer 4 disappear, but the charges trapped in the interface between the photoconductor 3 and the insulating layer 4 are not moved. In the dark area D, the photosensitive member 1 is charged in the reverse polarity. FIG. 5(III) shows the uniform exposure step in which the charges in the bright area L disappear, and in the dark area D the charges remain trapped across the insulating layer 4.

Figure 6:
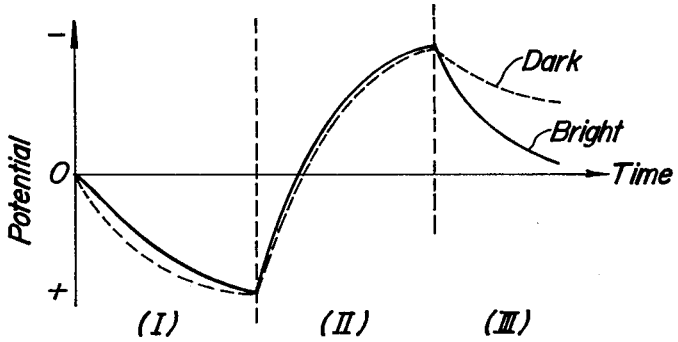
FIG 6 PRIOR ART
FIG. 6 is a graph illustrating the variation of surface potentials in the process shown in FIGS. 5(I) to 5(III)

FIG. 6 shows the variation in the surface potential of the photosensitive member 1 during the above steps. During the first step (I), the surface potential is increased to a certain positive voltage and then, in the second step (II), the surface potential is uniformly decreased to a certain negative voltage. During the third step (III), the surface potential in the imagewise bright area L is decreased to zero. In the imagewise dark area D, although the charges on the outer surface of insulating layer 4 do not change, since the charges on the conductive substrate 2 corresponding to the charges on the surface of insulating layer 4 are moved into the interface between the photoconductive layer 3 and insulating layer 4, the surface potential in the dark area D is also decreased to a small extent. However, since there still remains a large difference in the surface potentials in a bright and dark areas, the latent image having a large electrostatic contrast can be obtained.

Figure 7I:
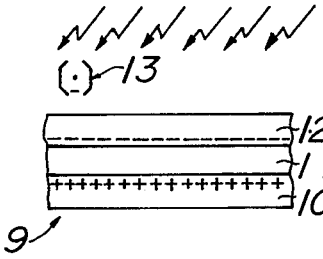
FIG 7(I) PRIOR ART
FIGS. 7(I) to 7(III) are schematic views showing still another embodiment of a known electrophotographic process.
Figure 7:
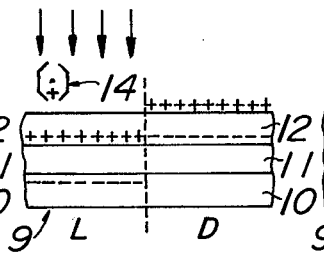
FIG 7(II) PRIOR ART
Figure 8:
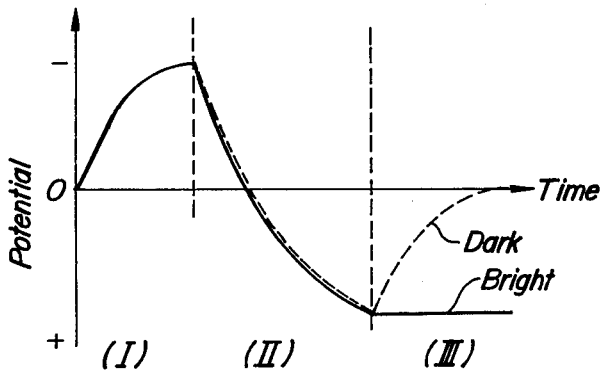
FIG 8 PRIOR ART
FIG. 8 is a graph illustrating the variation of surface potentials in the process shown in FIGS. 7(I) to 7(III)

FIGS. 7(I) to 7(III) and FIG. 8 show still another embodiment of a known electrophotographic process. In this embodiment, use is made of a photosensitive member 9 comprising a conductive substrate 10, an insulating layer 11 applied on the conductive substrate and a photoconductive layer 12 applied on the insulating layer. As shown in FIG. 7(I), the photosensitive member 9 is subjected to a uniform exposure and a primary charging by means of a corona charger 13 and charges are trapped across the insulating layer 11. Then, the photosensitive menber 9 is subjected to an imagewise exposure and a secondary charging by means of a corona charger 14 having a polarity opposite to that of the corona charger 13. During this step, in the imagewise bright area L, charges are trapped across the insulating layer 11 with polarity opposite to that of the step (I). In the imagewise dark area D, charges are trapped across the photoconductive layer 12. In this case, the surface potentials in the bright and dark areas become identical with each other. Then, the photosensitive member 9 is subjected to a uniform exposure as illustrated in FIG. 7(III). During this step (III), the charges on the bright area L do not change, but the charges in the dark area D are cancelled out so as to form a latent image.

FIG. 8 shows the change of the surface potentials in the above-mentioned steps. During the step (I), the surface potential is increased to a certain negative voltage, and during step (II) the surface potential is uniformly decreased to a certain positive voltage. In step (III), the surface potential in the bright area L does not change at all, as depicted by a solid line, but in the dark area D, the surface potential is changed in accordance with the irradiation time and finally becomes zero as illustrated by a broken line. In this manner, electrostatic contrast is produced between the bright and dark areas and a latent image is formed.

In the known electrophotographic processes so far explained with reference to FIGS. 1 to 8, use is made of a photosensitive member comprising a conductive substrate, a photoconductive layer and an insulating layer, and the process comprises the step of effecting simultaneously the imagewise exposure and charging and a final step for effecting uniform exposure. These known processes have a common drawback that the electrostatic latent image might be deteriorated to a great extent during the formation of a number of copies from the single latent image once formed on the photosensitive member. The present invention is to avoid such a drawback in a sophisticated manner.

Figure 9I:
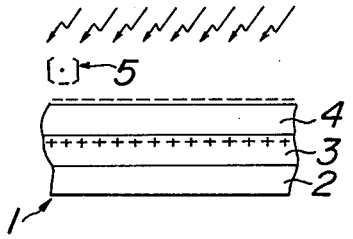
FIGS. 9(I) to 9(V) are schematic views depicting successive steps of an embodiment of the electrophotographic process according to the invention.
Figure 9:
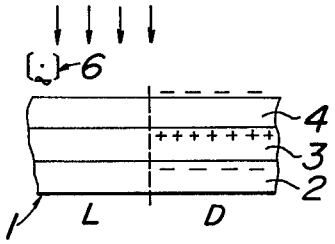
Figure 9:
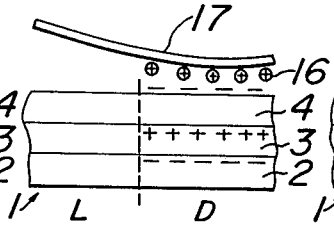
Figure 9V:
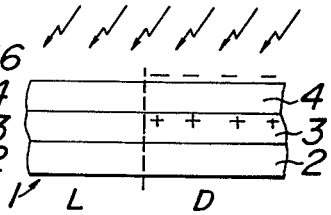
Figure 10:
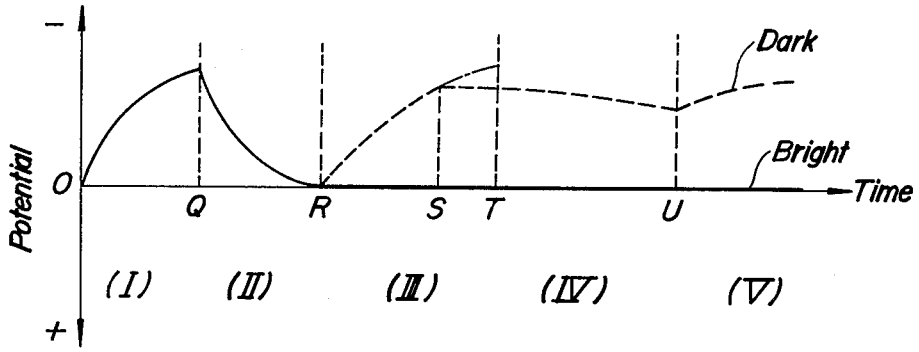
FIG. 10 is a graph showing the variation in surface potentials in imagewise dark and bright areas during the process shown in FIGS. 9(I) to 9(V)

FIGS. 9(I) to 9(V) illustrate successive steps of an embodient of the electrophotographic process according to the invention, and FIG. 10 shows a variation of the surface potentials in imagewise dark and bright areas during the steps. Steps shown in FIGS. 9(I) and 9(II) are the same as those shown in FIGS. 1(I) and 1(II), respectively, of the known process. That is to say, use is made of a photosensitive member 1 comprising a conductive substrate 2, a photoconductive layer 3 applied on the substrate 2 and an insulating layer 4 applied on the photoconductive layer 3. An example of such a photosensitive member 1 will be described hereinbelow. The conductive substrate 2 is formed by a drum made of aluminum on which a photoconductive layer 3 having a thickness of about 30 to 50 μm and made of amorphous silicon or Se-Te alloy is applied by vacuum evaporation. The insulating surface layer 4 has a thickness of about 10 to 40 μm and is made of polyethylene terephthalate or polypara-xylyrene.

In step (I) of FIG. 9(I), the photosensitive member 1 is uniformly charged by means of a corona charger 5 under a uniform exposure to trap charges across the insulating layer 4. This uniform charge may be effected up to −2,000 V. In the next step (II) shown in FIG. 9(II), the imagewise exposure is effected for time Q, while a secondary charging is carried out by means of a corona charger 6 of a polarity opposite to that of the corona charger 5. During this step (II), the charges in an imagewise bright area L disappear, but in an imagewise dark area D, since the charges are trapped in the interface between the photoconductive layer 3 and insulating layer 4, only a part of the negative charge on the outer surface of the insulating layer 4 is removed and a certain amount of negative charge is induced in the interface between the conductive substrate 2 and photoconductive layer 3. It should be noted that apparent surface potentials in both the dark and bright areas become zero.

Next, the photosensitive member 1 is subjected to a uniform exposure at time R as depicted in FIG. 9(III). During this step (III), the amount of irradiation is so controlled that the surface potential in the dark area D, and thus the electrostatic contrast, does not reach a saturated value. Therefore, there remains an amount that the electrostatic contrast can be further increased. During this step (III), only a small amount of the charge trapped in the interface between the photoconductive layer 3 and insulating layer 4 in the imagewise dark area D can be cancelled out, because the illumination is effected for a limited period. In other words, in said interface, there remain the charges which are larger than the corresponding charges on the outer surface of insulating layer 4. In the imagewise bright area L, the surface potential remains substantially zero. According to the invention, the uniform exposure is so effected that the surface potential in the dark area D becomes 60 to 90% of the maximum value. For instance, if the maximum surface potential is about −400 volts, then the surface potential in the dark area D becomes about −240 to −360 volts at the end of the uniform exposure.

FIG. 9(IV) illustrates step for effecting development and transfer. That is to say, the latent image is first developed with toners 16 to form a toned image which is then transferred onto a record paper 17. During this step (IV), the photosensitive member 1 is contacted with the developing agent 16 and the record paper 17, and there-fore, a certain amount of the charges of the latent image leaks and the electrostatic contrast is gradually decreased in accordance with the increase of the number of duplicated copies as shown by region (IV) in FIG. 10. FIG. 9(V) illustrates the step of restoring the latent image having the thus-reduced contrast. In step (III) shown in FIG. 9(III), since the uniform exposure is interrupted at a time S before the electrostatic contrast would reach the saturated maximum value at time T, the charges trapped in the interface between the photoconductive layer 3 and insulating layer 4 are greater than the corresponding to charges on the outer surface of insulating layer 4 and the charges in said interface serve to weaken an external field due to the charges on the outer surface of insulating layer 4. In step (V), the photosensitive member 1 is subjected to an additional uniform exposure at an instant U. Then, the charges trapped in the interface between the photoconductive layer 3 and insulating layer 4 in the imagewise dark area D are partially removed and thus, the surface potential in the imagewise dark area D is increased in negative polarity as illustrated by the broken line in region (V) in FIG. 10. On the other hand, the surface potential in the imagewise bright area L remains substantially at zero. Therefore, the electrostatic contrast of the latent image is increased. In this manner, the latent image can be restored. The additional total exposure may be effected in various ways. For instance, the additional total exposure may be carried out after the formation of every copy or it may be conducted after the formation of a predetermined number of copies, such as four or five copies. According to the invention, the restoration of the deteriorated latent image may be effected in accordance with the variation of the surface potential to such an extent that the electrostatic contrast can be maintained within an acceptable range during the duplication. In this case, it is necessary that the charge is not over-compensated.

Figure 11I:
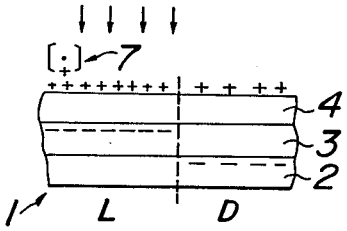
FIGS. 11(I) to 11(V) are schematic views illustrating successive steps of another embodiment of the electrophotographic process according to the invention.
Figure 11:
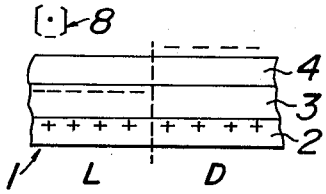
Figure 11:
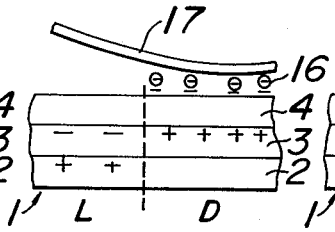
Figure 11V:
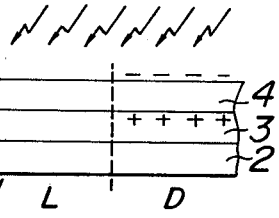
Figure 12:
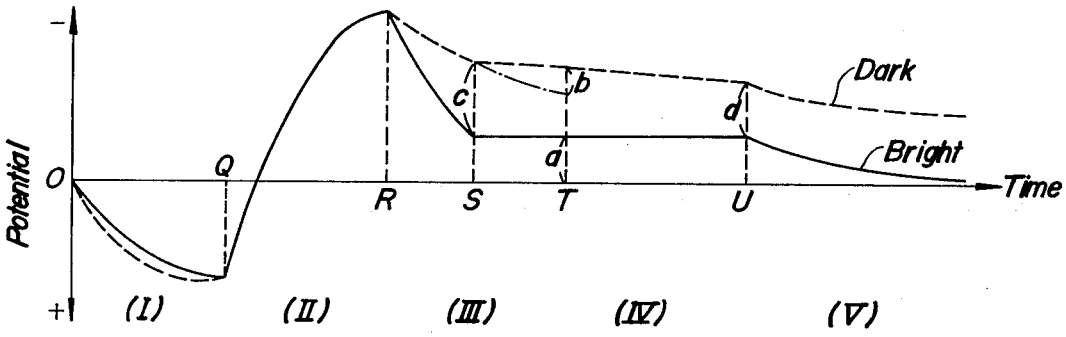
FIG. 12 is a graph showing the variation in surface potentials in the process depicted in FIGS. 11(I) to 11(V).

FIGS. 11(I) to 11(V) illustrate successive steps of another embodiment of the electrophotographic process according to the invention, and FIG. 12 is a graph showing the variation of the surface potentials in imagewise dark and bright areas. The first two steps shown in FIGS. 11(I) and 11(II) are the same as those of the known electrophotographic process depicted in FIGS. 5(I) and 5(II). Also in this embodiment, use is made of the same photosensitive member 1 as that used in the previous embodiment. In step (I) shown in FIG. 11(I), the primary charging is effected by a corona charger 9, while the photosensitive member 1 is subjected to the imagewise exposure. This primary charging may be effected up to about +2,000 volts. Then, in step (II) illustrated in FIG. 11(II), the secondary charging is carried out at time Q by means of a corona charger 8 having an opposite polarity to that of the corona charger 7 and until the surface potential has reached about −1,500 volts. Next, in step (III) shown in FIG. 11(III), the photosensitive member 1 is subjected to a uniform exposure at an instant R. That is to say, this uniform exposure is interrupted at an instant S in FIG. 12 before an instant T at which the electrostatic contrast will reach the maximum saturated value of about −500 volts if the uniform exposure would be continued. Therefore, in the imagewise bright area L, a certain amount of charges still remain across the photoconductive layer 3 as shown in FIG. 11(III). In the imagewise dark area D, a sufficient amount of charges corresponding to an amount of charges on the outer surface of insulating layer 4 could not move from the conductive substrate 2 into the interface between the photoconductive layer 3 and insulating layer 4. Therefore, as shown in region (III) in FIG. 12, there are margins of a and b volts by which voltages the surface potentials in the bright and dark areas, respectively, would be changed further. At the instant S, the electrostatic contrast of the latent image has a magnitude of c volts.

Step (IV) shown in FIG. 11(IV) is a development and transfer during which the latent image is developed with toners 16 and a toned image is transferred onto a record paper 17. It is apparent that if the latent image is not deteriorated at all during the formation of a plurality of duplicated copies by repeating the development and transfer, the image quality of the duplicated copies does not diminish. However, in practice, the electrostatic charges of the latent image leak due to the contact between the photosensitive member with the toners 16 and record paper 17. Therefore, the electrostatic contrast is decreased in accordance with the formation of a plurality of copies, and at an instant U the contrast is decreased to d volt as shown in FIG. 12.

According to the invention, the deteriorated latent image is restored by effecting a uniform exposure in the step (V), shown in FIG. 11(V), at the instant U. Then, the surface potential in the bright area L is decreased to a larger extent than the decrease of the surface potential in the dark area D. This results because the electrostatic contrast is increased. As explained above, since the surface potentials in both the dark and bright areas are decreased, if the latent image is developed by means of a magnetic brush developing device, the density of the duplicated copies might be decreased. However, such a drawback can be easily removed by means of any one of the known measurements. For instance, use may be made of a cascade developing device in which the image density corresponding to the electrostatic contrast can be obtained. Alternatively, a developing bias voltage in the magnetic brush developing device may be changed in accordance with the decrease in the surface potentials to obtain constant density, particularly in a lower density portion similar to a background.

As can be seen from the above explanation, in the electrophotographic process according to the invention, the decrease in the electrostatic contrast of the latent image can be restored during the formation of a plurality of copies by repeating the development and transfer for the same and single latent image once formed on the photosensitive member, and thus a plurality of copies having an excellent image quality can be reliably obtained.

It should be noted that the present invention is not limited to the embodiments explained above, but many modifications and alternations may be conceived by a person who is skilled in the art. For example, the present invention may be equally applied to the known electrophotographic process shown in FIGS. 3 and 7. In applying the invention to the process illustrated in FIG. 7, use may be made of the photoconductive member comprising the conductive substrate, the insulating layer applied on the substrate and the photosensitive layer applied on the insulating layer. Further, the amount of the uniform exposure for forming the latent image may be effected to such an extent that the electrostatic constrast of the latent image becomes 60 to 90 percent of the maximum saturated contrast. This may be effected by adjusting the light amount of the uniform exposure and this light amount may be adjusted by controlling the exposure time and/or the exposure light intensity. In practice, it is rather difficult to control the exposure time and thus, the exposing light intensity is preferably reduced.

Further, in the above embodiment the electrostatic contrast is restored by effecting the additional uniform exposure, but if the photoconductive layer has a sufficiently low resistance, it is not always necessary to effect the additional total exposure. Also in this case, the deterioration of the charge image is continuously compensated for during the formation of copies.

What is claimed is:

1. An electrophotographic process for forming a plurality of copies of an original from the same and single electrostatic charge image once formed on a photosensitive member which comprises a conductive substrate, a photoconductive layer and an insulating layer, the layers being applied on the conductive substrate, said process comprising the steps of:

(a) effecting simultaneously an imagewise exposure of the original and charging the photosensitive member to form a latent charge image thereon;

(b) subjecting the photosensitive member to a uniform exposure to such an extent that the charge image has an electrostatic contrast which is equal to 60 to 90 percent of the maximum attainable electrostatic contrast;

(c) developing the charge image with a toner to form a toner image;

(d) transferring the toner image onto a record member to form a copy;

(e) repeating said developing and transferring steps for the same and single latent image to form a plurality of copies; and (f) subjecting the photosensitive member to an additional uniform exposure during said repeating step to restore the electrostatic contrast of the latent charge image.

2. A process according to claim 1, wherein said additional uniform exposure is effected every time a single copy has been formed.

3. A process according to claim 1, wherein said additional uniform exposure is effected every time a predetermined plural number of copies have been formed.

4. A process according to any one of claims 2 or 3, wherein said additional uniform exposure is effected under an adjusted light intensity.

5. A process according to claim 1, wherein said step (a) comprises effecting a primary uniform exposure and a primary charging in one polarity; and effecting simultaneously an imagewise exposure and a secondary charging in the other polarity.

6. A process according to claim 1, wherein said step (a) comprises effecting a primary uniform exposure and a primary charging in one polarity; and effecting simultaneously an imagewise exposure and a secondary A.C. charging.

7. A process according to claim 1, wherein said step (a) comprises effecting simultaneously an imagewise exposure and a primary charging in one polarity; and effecting a secondary charging in the other polarity.

8. A process according to claim 1, wherein said step (a) comprises effecting simultaneously an imagewise exposure and a primary charging in one polarity; and effecting a secondary A.C. charging.

9. A process according to claim 1, wherein said step (a) comprises effecting simultaneously an imagewise exposure and a primary charging in one polarity; and effecting a secondary charging in the other polarity.

10. A process according to claim 1, wherein said step (a) comprises effecting a primary uniform exposure and a primary charging in one polarity; and effecting simultaneously an imagewise exposure and a secondary charging in the other polarity.

* * * * *